US008864474B2

(12) United States Patent
Nelson et al.

(10) Patent No.: US 8,864,474 B2
(45) Date of Patent: Oct. 21, 2014

(54) METHOD AND APPARATUS FOR A PERISTALTIC PUMP

(75) Inventors: James E. Nelson, North Branch, MI (US); Troy A. Bartz, Lake Orion, MI (US)

(73) Assignee: Curlin Medical Inc., East Aurora, NY (US)

( * ) Notice: Subject to any disclaimer, the term of this patent is extended or adjusted under 35 U.S.C. 154(b) by 800 days.

(21) Appl. No.: 13/127,513

(22) PCT Filed: Nov. 9, 2009 (Under 37 CFR 1.47)

(86) PCT No.: PCT/US2009/063747
§ 371 (c)(1), (2), (4) Date: Oct. 17, 2011

(87) PCT Pub. No.: WO2010/054327
PCT Pub. Date: May 14, 2010

(65) Prior Publication Data

US 2013/0189120 A1 Jul. 25, 2013

Related U.S. Application Data

(60) Provisional application No. 61/198,903, filed on Nov. 10, 2008.

(51) Int. Cl.
*F04B 49/06* (2006.01)
*F04B 43/08* (2006.01)
*F04B 43/12* (2006.01)

(52) U.S. Cl.
CPC ..... *F04B 43/1253* (2013.01); *F04B 43/1261* (2013.01)
USPC ..... 417/44.1; 417/53; 417/477.1

(58) Field of Classification Search
USPC ..... 417/44.1, 53, 477.1
See application file for complete search history.

(56) References Cited

U.S. PATENT DOCUMENTS

| | | | | | |
|---|---|---|---|---|---|
| 2,811,931 | A * | 11/1957 | Everett | 417/265 |
| 3,826,593 | A * | 7/1974 | Von Casimir | 417/53 |
| 4,473,173 | A * | 9/1984 | DeGroff et al. | 222/63 |
| 4,648,812 | A * | 3/1987 | Kobayashi et al. | 417/474 |
| 5,003,239 | A * | 3/1991 | Matthews et al. | 318/600 |
| 6,099,272 | A * | 8/2000 | Armstrong et al. | 417/476 |
| 6,213,723 | B1 | 4/2001 | Danby et al. | |
| 7,645,127 | B2 * | 1/2010 | Hagen et al. | 417/477.12 |
| 2005/0084402 | A1 | 4/2005 | Vanek | |
| 2005/0095155 | A1 | 5/2005 | Blight et al. | |

* cited by examiner

*Primary Examiner* — Charles Freay
(74) *Attorney, Agent, or Firm* — Hodgson Russ LLP

(57) ABSTRACT

A method of fluid delivery from a rotary peristaltic pump is provided. A roller assembly having a plurality of rollers is provided, the roller assembly having at least one anomalous range. A rotational position of the plurality of rollers is determined. A speed of the plurality of rollers is increased when at least one of the plurality of rollers is in the anomalous range and the speed of the plurality of rollers is decreased when each of the plurality of rollers is outside the anomalous range.

6 Claims, 3 Drawing Sheets

METHOD AND APPARATUS FOR A PERISTALTIC PUMP

CROSS-REFERENCE TO RELATED APPLICATIONS

This application claims the benefit of U.S. Provisional Application No. 61/198,903 filed Nov. 10, 2008, the contents of which are incorporated by reference herein.

BACKGROUND

The present disclosure relates generally to infusion pump systems, and more particularly to rotary peristaltic pumping systems.

Rotary peristaltic infusion pumps deliver fluid by sequentially compressing a tube with a plurality of rotating rollers. The tube is constrained within a track such that as the rollers rotate, one or more occlusion points or occlusion regions are formed where the roller compresses the tube against the track. As the rollers advance, the occlusion points or regions progress along the length of tube, thereby drawing fluid into the tube inlet, and forcing fluid out of the tube outlet. Assuming that the tube is elastic, and returns to its original dimensions once it passes each occlusion point or occlusion region along its length, the rate of pumping is generally governed by the rotation rate of the rollers, the radius at which the pumping action occurs, the inner cross sectional area of the tube, and/or the angular velocity of the roller assembly.

SUMMARY

A method and apparatus for substantially leveling fluid delivery from a rotary peristaltic pump is provided to substantially deliver an even and level flow of fluid to a patient during operation of the pump.

In accordance with one aspect of the invention, a method of fluid delivery from a rotary peristaltic pump is provided. It comprises providing a roller assembly having a plurality of rollers, the roller assembly having at least one anomalous range and determining a rotational position of the plurality of rollers. The method further comprises increasing a speed of the plurality of rollers when at least one of the plurality of rollers is in the anomalous range and decreasing the speed of the plurality of rollers when each of the plurality of rollers is outside the anomalous range.

In accordance with another aspect of the invention, a rotary peristaltic pump is provided. The pump comprises a pump housing and a roller assembly within the pump housing. The roller assembly comprises a plurality of rollers operatively connected to a rotating shaft and a flexible tube contained within a track of the roller assembly, the plurality of rollers impinging upon the flexible tube. The pump also includes a motor for driving the rotating shaft and a controller operatively connected to the motor. At least one rotational position sensor is operatively connected to the plurality of rollers for determining a rotational position of the rollers relative to said track.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

The invention compensates for flow variations caused by changes in flow path volume. Generally flow variations are caused by compression and release of the tube during operation of a rotary peristaltic pump that has the effect of delivering a compensating surge of volume of fluid delivered.

Figure 1:
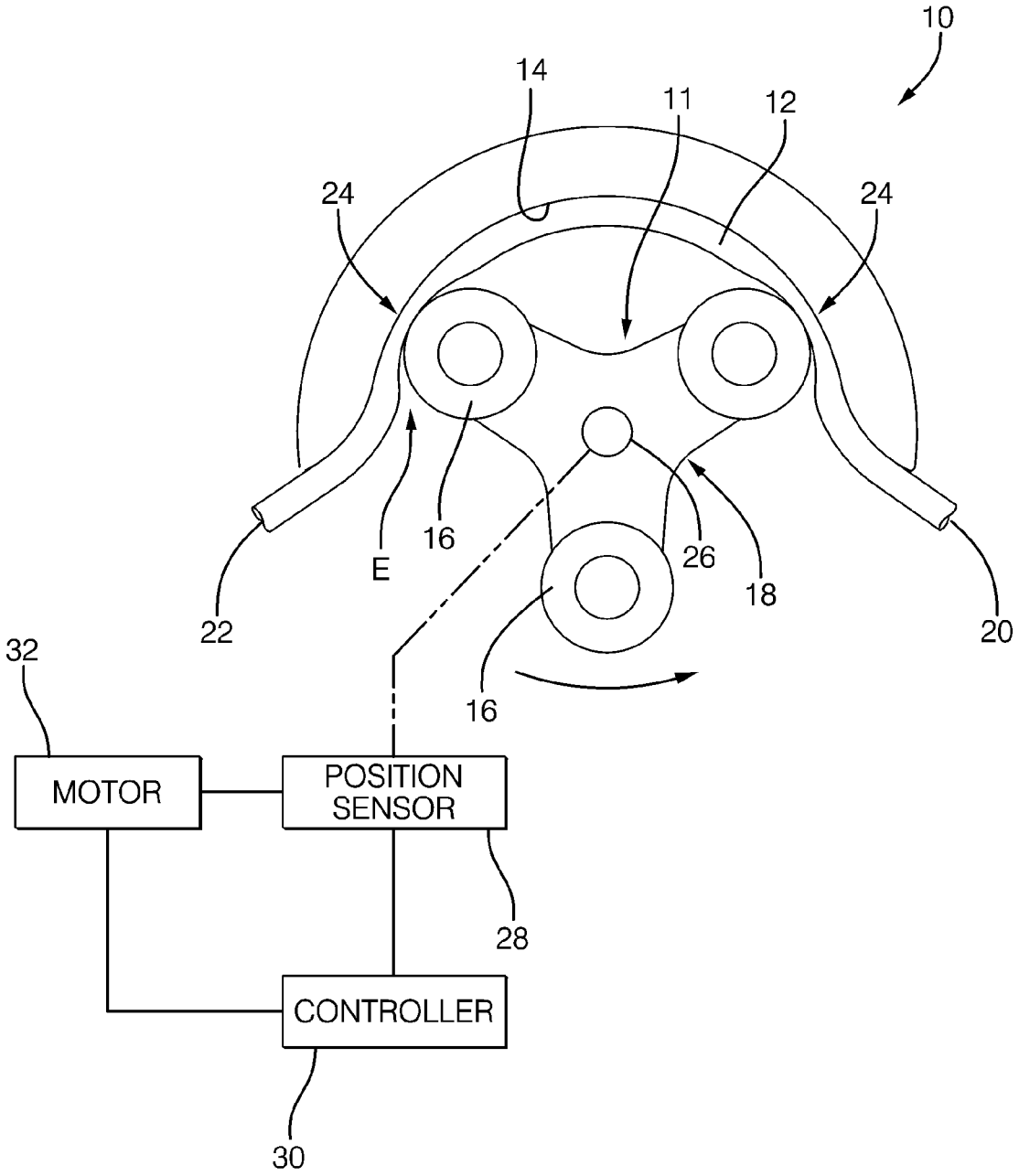
FIG. 1 is an exemplary embodiment, partially in schematic of a pump in accordance with the invention.

Referring now to FIG. 1, a rotary peristaltic pump assembly is designated generally at 10. The pump assembly 10 includes a roller carriage or roller assembly 11 having three rollers 16, a tube 12 within an arcuate track 14 and a rotating shaft 26. In alternate exemplary embodiments any number of rollers 16 may be used. However, generally at least two rollers 16 are used to balance rotation of the rollers 16 which are operatively connected to, and rotating with the shaft 26.

The tube 12 is constrained within the track 14 of the pump assembly 10 such that as the rollers 16 rotate one or more occlusion points or occlusion regions 24 are formed where the respective roller 16 compresses the tube 12 against the track 14. As the rollers 16 advance, the occlusion points or occlusion regions 24 progress along the length of tube 12, thereby drawing fluid into a tube inlet 20, and forcing fluid out of a tube outlet 22.

Figure 2A:
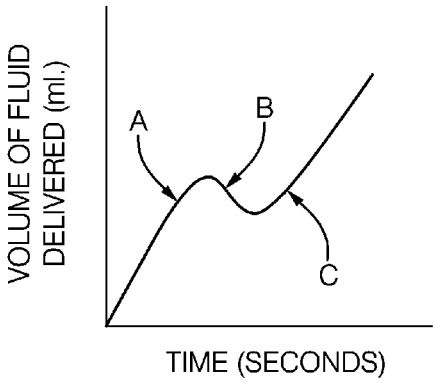
PRIOR ART FIG. 2 A
FIGS. 2A and 2B are graphs depicting flow volume and change in flow volume, respectively, versus time, of a flow anomaly in a prior art peristaltic pump.
Figure 2B:
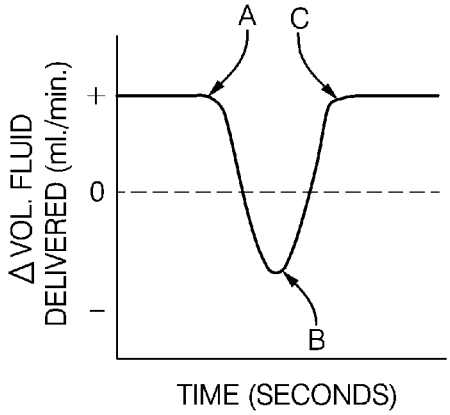
PRIOR ART FIG. 2 B

Generally, peristaltic pumps exhibit a flow anomaly such as a diminution in flow, or even backflow, as each leading roller 16 exits the track 14 in a roller exit area or ramp area E adjacent the tube outlet 22, where leading roller 16 loses contact with the tube 12. A graphical illustration of a flow anomaly is seen in FIGS. 2A and 2B. FIG. 2A graphically represents the volume of fluid delivered relative to time for a standard prior art peristaltic pump. FIG. 2B shows how the volume of fluid changes over time for a standard prior art peristaltic pump. As seen in both graphs, the flow anomaly designated B begins when leading roller 16 exits roller exit area or ramp area E in FIG. 1, at tube outlet 22.

When the leading roller 16 exits the ramp area E, the occlusion of the tube 12 is released, and the tube 12 locally resumes its original cross section. While the following roller 16 is still advancing the fluid column, the restoration of the tube 12 to its original dimension results in a flow component that is opposite to the pumping direction. Depending on the profile and extent of the ramp area E, this effect may be spread over a lesser or greater extent, but the anomaly will be present. For example, it is possible to reduce, but not eliminate the flow anomalies by extending the ramp area E of the infusion/administration set. However, this generally increases the dimensions of the infusion set, and complicates the design of the mechanism for inserting and ejecting the set from a pump because a tube is wrapped further around the rollers.

Further, upstream pressure may cause a transient backflow as the leading occlusion is released, and the length of tube 12 between the leading roller 16 and the following roller 16 is pressurized by the upstream delivery pressure. This can result in a pulsed component to the flow which may be undesirable in some instances, such as at lower delivery rates wherein the backflow or diminution in flow may be a relatively significant portion of the delivered quantity for timescales on the order of several minutes.

As is apparent, there is generally one occlusion region 24 corresponding to each roller 16. If there are three rollers 16, and the span of the range is, e.g., 2 degrees, and the rollers 16 are equally spaced, there will be an occlusion region at about 119-121 degrees, 239-241 degrees, and 359-1 degrees. However, as discussed above, the duration of the flow anomaly is much larger since the flow anomaly is dependent upon many factors including at least the localized geometry of track 14 in ramp area E, the elasticity of tube 12, and/or the ambient air temperature. As used herein, an anomalous range is a function of time and a function of the degrees of rotation of roller carriage 11 when the flow anomaly exists. As such, the anomalous range is defined as when and how long the flow anomaly exists. The flow anomaly may exist for the duration of time that exists between when the leading roller 16 exits the track area E, releasing the occlusion of the tube 12, and when the tube 12 locally resumes its original cross section. In the embodiment shown, the duration of the flow anomaly of pump 10 correspond to 34 degrees of rotation of roller carriage 11.

As a non-limiting example of size of a flow anomaly, if the tube 12 increases in volume by 1 mL when the roller 16 no longer compresses the tube 12, then the flow anomaly with be 1 mL per the time it takes for the tube 12 to change from compressed to not compressed. For example, assume it takes one second for the tube to be completely uncompressed. The average of this flow anomaly would be 1 mL per second.

In another exemplary embodiment in accordance with the pump 10, the increase in volume due to tube 12 decompression in the pump 10 shown is on the order of 20 microlitres. The anomalous flow duration will depend on the flow rate, and is about 1 second at a flow rate of about 125 ml/hr. This gives an average flow component due to decompression of 20 ul/1 sec. Thus, the anomalous flow component can be calculated as:

$$20\ \text{ul/sec} * 3600\ \text{sec/hr} * 1000\ \text{ul/ml} = 72\ \text{ml/hr}$$

This is an average flow component and the peak flow is substantially higher—approximately two times the average flow, as measured. As such a peak flow of anomalous flow component is a about 144 ml/hr. Calculating a net peak flow:

$$125\ \text{ml/hr} - 144\ \text{ml/hr} = -19\ \text{ml/hr at peak backflow.}$$

The above examples scale for different flow rates. For reasonably low flows, the duration of the anomalous flow duration will scale in inverse proportion to the infusion rate, and the peak flow scales in direct proportion to the infusion rate, yielding a proportionally similar net negative flow.

Generally, as seen above, the flow during the flow anomaly may be in the opposite direction to the normal flow, and when a summation is computed with the normal flow, shows that the flow is lessened—and potentially reversed if the flow anomaly exceeds the normal flow. The magnitude and duration of a flow anomaly in accordance with the prior art is graphically represented at the area B shown in FIGS. 2A and 2B.

Figure 3A:
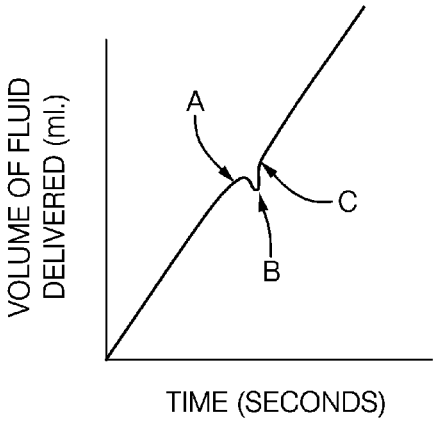
FIGS. 3A and 3B are graphs similar to FIGS. 2A and 2B, showing a flow anomaly in accordance with the present invention.
Figure 3B:
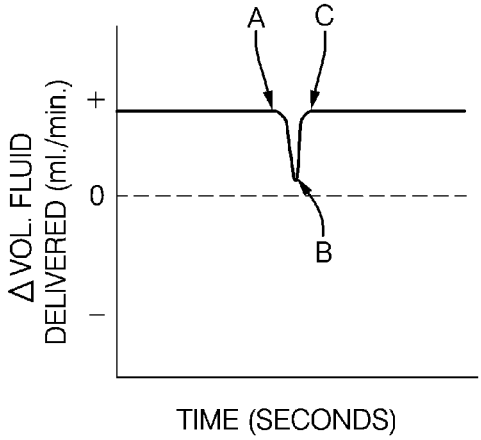
Figure 4:
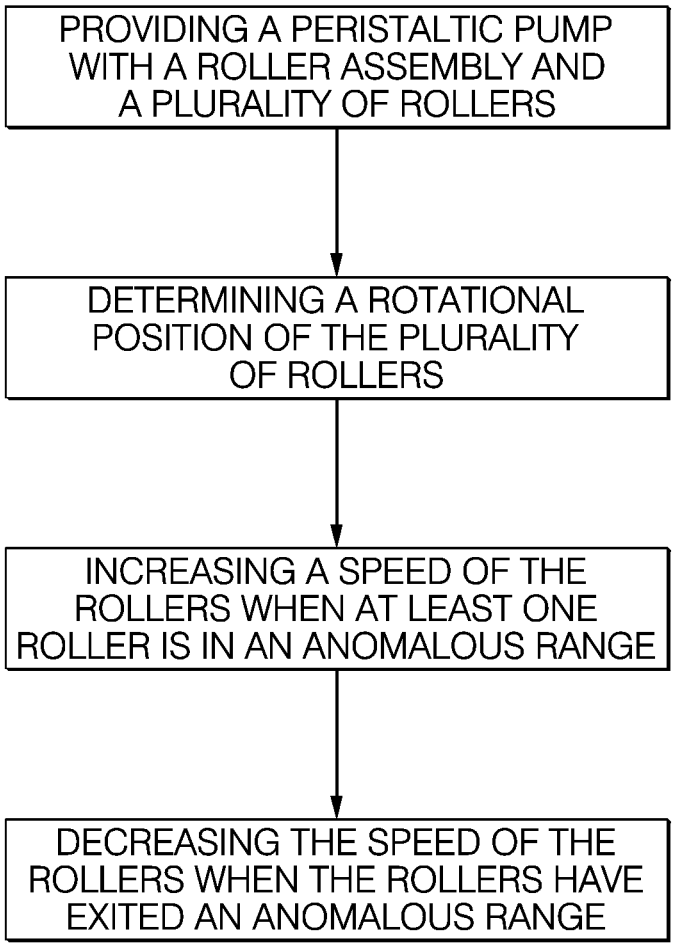
FIG. 4 is an exemplary embodiment of a method in accordance with the invention.

According to exemplary embodiments of the invention, both the magnitude and duration of the flow anomaly may advantageously be lessened by determining the rotational positions of a plurality of rollers 16 in the rotary peristaltic pump 10. Exemplary embodiments of the method disclosed herein include adjusting the speed of rotation of roller carriage 11 when rollers 16 are in an anomalous range. In an exemplary embodiment, the speed of rollers 16 is increased at least when the rollers 16 are in the at least one anomalous range, in a manner sufficient to lessen the duration of time during which the flow anomaly occurs. In this manner, a substantially level flow of fluid is delivered during operation of the pump 10. The roller speed is then decreased once the anomalous range is passed. The result of the invention is shown graphically in the illustration of FIGS. 3A and 3B, where the effect of the flow anomaly has been minimized or even eliminated. The exemplary embodiment of the method is shown in FIG. 4.

It is to be understood that the position of the rollers 16 may be determined in a variety of ways. Some non-limiting examples include sensing, via suitable sensors reading the positions of shaft 26; reading the direct rotational position of e.g., a motor 32 operatively connected to rollers 16 through shaft 26, via (for example) a high resolution encoder; detecting the rotational position a number of times throughout the rotation of the driving motor 32. In one example, 1 time per revolution of the motor 32—the position of the rollers 16 between 1 time/revolution sensing events can be "determined" by integrating the rotational velocity of the motor 32, and the integral of velocity is displacement); or the like; or combinations thereof. Velocity may be measured or calculated. Higher precision in determining velocity gives higher precision in determining displacement.

Using measurement of velocity allows the position of the shaft to be interpolated, once shaft position has been determined via a shaft sensor or similar means. Rotational sensors (such as, e.g. Hall sensors) give incremental position information, but the position of shaft 26, and thus roller 16 position is determined at least once for this information to be used to anticipate onset of the flow anomalies. Accurate incremental rotation can be sensed in a non-limiting example where the motor 32 that gives 36 transitions of the Hall sensors per motor revolution, coupled to the shaft 26 with a 28.4444444:1 gear ratio gives Hall sensor 1024 indications per revolution of the roller assembly 11.

A position sensor 28, shown in FIG. 1, is operatively connected to the pump assembly 10. Position sensor 28 may comprise slotted switch optical sensors, magnetic sensors (e.g. Hall sensors), or the like, or combinations thereof. Such a sensor is arranged to give a signal informing a controller 30 exactly at, or in advance of the roller 16 position at which the flow anomaly occurs. The controller 28 directs a motor 32 operatively connected to shaft 26 to increase the rotational speed, thus increasing the speed of roller assembly 11 and of the rollers 16 during transit of the anomaly. This reduces the time duration of the flow anomaly. The speedup of motor 32 is timed to cover the anomaly. Thereafter, in one exemplary embodiment, the rotational speed of motor 32 is returned to its original speed and flow is returned to a linear trend, as shown graphically at C in FIG. 3A.

In another non-limiting example of a pump assembly 10, a signal precedes the correction by some fixed amount. In an embodiment, the sensor 28 provides a signal about 45 degrees of rotation in advance of the anomaly.

In another non-limiting embodiment of the invention, position sensor 28 or another sensing mechanism contemplated under the invention is such that each anomaly is preceded by a signal or indication so that the pump 10 could react in real time. The limiting case for "preceded by" could be near zero if the hardware/software is capable of speeding up in a small time relative to the duration of the anomaly. In a rotary peristaltic pumping system driven by motor 32 with an incremental sensing means (e.g., Hall sensors) and a fixed gearbox (not shown), a single index position may anticipate any phenomena that occur regularly with rotation (such as flow anomalies). As such, it is not necessary to know how soon before (or after) the anomaly that the signal from the sensor 28 occurs. Once one knows the shaft 26 position, and the phasing of the anomalies, it is possible to correct the anomalies to those shown in FIGS. 3A and 3B regardless of when the sensor indicia occur.

Speedup of the rollers 16 is beneficial in at least two ways: 1) the time of the flow anomaly is reduced; and 2) the downstream fluid mass, the flow striction of the downstream tube 12, and the compliance of the tube 12 will give a lagging tendency to the fluid flow. If the duration of the speedup is shorter than the lag time constant of the fluid/delivery tube system, then the magnitude of the flow anomaly is also reduced. In fact, with narrow gage tubing 12, the flow anomaly is largely eliminated. The duration and timing of the modified delivery speed may be determined by finely measuring the delivery of a plurality of pump assemblies 10 for various defined delivery rates versus roller 16 position, a speedup that yields the most even flow can be empirically calculated.

Compensation adjusts pump flow rate (e.g., mL/sec) due to pump speed as closely as possible to equal to the rate of change in volume (mL/sec) of the tube 12 due to decompression throughout the anomaly range in track area E. Since the anomaly will be regular and predictable, a predetermined speed adjustment may be used to offset the anomaly.

With roller position sensing, and measuring the delivery of a population of pump assemblies vs. roller 16 position, a continuous speed profile can be developed. In the exemplary embodiment, controller 30 would vary speed of the rollers 16 continuously throughout the cycle of roller assembly 11 to compensate substantially for any deviation of the pump assembly to develop a generally linear flow.

Pump assembly 10 is also capable of utilizing non-continuous rotation of roller assembly 11 to achieve an intermittent flow or a very low flow delivery. When operating intermittently, the infusion pump will deliver a small amount of drug, such as 0.005 mL at a higher rate over a short period of time, then pause for a time. This reduces the average rate of infusion in proportion to the quantity (running time) per (total of running and non-running time). As long as the timing of the flow pulses or bolii is short relative to the half life of the medication, the flow will appear to be physiologically constant. In this manner, the motor 32 can be idle the majority of the time, saving considerable power, and a more stable control algorithm can be used to run the motor 32 at a higher speed when it is operating.

In a non-limiting example, when the pump 10 is delivering up to about 25 mL/hr, bolii are dispensed of just under 1/200 mL, each of about 0.1 second duration. This means that the pump 10 dispenses about 2000 bolii per hour when pumping at 10 mL/hr. At this pumping rate, the pump 10 dispenses a bolus of 0.1 second duration about every 1.8 seconds. The pump 10 pumps for 0.1 seconds, then dwells for 1.7 seconds. At 1 mL/hr, the bolus duration is the same, but the repetition rate is 10 times slower, the pump 10 pumps for 0.1 seconds, and dwells for 17.9 seconds. In a further example, the pump 10 pumps for 0.1 seconds, and dwells for 179.9 seconds.

Most drugs have half lives on the order of at least 10's of minutes to hours or more, with some exceptions. As long as several bolii occur per half life cycle, the serum concentration of the therapy may be suitably constant with time, generally following an exponential decay, decaying to half concentration at 0.693=1n(0.5) time constants.

Such an infusion mode may advantageously be utilized in order to achieve a substantially level flow. By determining the roller 16 rotational position to anticipate the onset of a flow anomaly, the duration and timing of one intermittent flow pulse per roller cycle can be lengthened so that the anomaly is generally spanned, and the desired net flow for the lengthened pulse is substantially the same as the non-lengthened pulses.

Although the methods as disclosed herein are shown in connection with rotary peristaltic pumps, it is to be understood that these methods may advantageously be applied to pumps other than rotary peristaltic mechanisms and may permit use of less linear pumping mechanism designs. The invention improves accuracy in fluid delivery/performance, greater flexibility and ease in the design of pump assemblies or infusion/administration sets, and greater flexibility in the design of pumping mechanisms.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A method of fluid delivery from a rotary peristaltic pump comprising:

providing a roller assembly having a plurality of rollers, the roller assembly having at least one anomalous range;

determining a rotational position of said plurality of rollers;

increasing a speed of said plurality of rollers when at least one of said plurality of rollers is in said anomalous range; and decreasing the speed of the plurality of rollers when each of said plurality of rollers is outside said anomalous range.

2. The method of claim 1, wherein determining a rotational position of said plurality of rollers includes sensing the rotational position with at least one Hall sensor operatively connected to said rotary peristaltic pump.

3. The method of claim 2, wherein said at least one Hall sensor is connected to a rotating shaft of said pump.

4. The method of claim 1, wherein determining a rotational position of said plurality of rollers includes determining the velocity of a motor operatively connected to the roller assembly and integrating the velocity of the motor.

5. The method of claim 1, wherein a controller directs a motor operatively connected to the roller assembly to increase or decrease the speed of the plurality of rollers.

6. The method of claim 1, including intermittently stopping the rotation of said roller assembly when each of said plurality of rollers is outside said anomalous range.

* * * * *